US006471287B1

(12) United States Patent
Liu

(10) Patent No.: US 6,471,287 B1
(45) Date of Patent: Oct. 29, 2002

(54) SLIDE FOLDING STRUCTURE FOR FOLDING CHAIRS AND CHAIRS

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/903,514

(22) Filed: Jul. 13, 2001

(51) Int. Cl.[7] ..... A47C 3/02
(52) U.S. Cl. ..... 297/32; 297/35; 297/39
(58) Field of Search ..... 297/32, 35, 40, 297/38, 39, 46, 50, 16.1, 20, 29, 33, 378.1, 18

(56) References Cited

U.S. PATENT DOCUMENTS 1,949,282 A * 2/1934 Murray ..... 297/18 X
2,567,341 A * 9/1951 Martin ..... 297/18
3,968,991 A * 7/1976 Maclaren ..... 297/39 X
5,253,921 A * 10/1993 Boulet ..... 297/16.1

* cited by examiner

*Primary Examiner*—Anthony D. Barfield
(74) *Attorney, Agent, or Firm*—Bacon & Thomas, PLLC

(57) ABSTRACT

A slide folding structure for folding chairs and chairs includes an anchor yoke fixedly mounted to a support frame to fasten to a rear leg and to serve as a fulcrum, and a displacement yoke slidably mounted to the support frame for fastening to a front leg. When applying force on the chair frame, the front leg will be moved to drive the displacement yoke sliding on the support frame for a selected displacement to fold or extend the folding chair thereby to decrease the folding displacement and enhance safety.

6 Claims, 8 Drawing Sheets

PRIOR ART Fig. 1

SLIDE FOLDING STRUCTURE FOR FOLDING CHAIRS AND CHAIRS

BACKGROUND OF THE INVENTION

The present invention relates to a slide folding structure for folding chairs and chairs and particularly a sliding displacement yoke mounting on a support frame of folding chairs and the seat pad of chairs for decreasing folding displacement and enhancing safety.

A conventional rocking chair, as shown in FIG. 1, generally includes a chair, a support frame located at two sides of the chair and at least one rocker frame located at the bottom of the support frame. The support frame consists of a front leg and a rear leg. The rocker frame has an anchor yoke fixedly mounted on a rear section with a pivot section extended upwards for pivotally engaging with the rear leg. There is a pivotal member pivotally mounted on a front section of the rocker frame at an axis. The pivotal member has another end pivotally engaging with a lower end of the front leg. The pivotal member may rest on the rocker frame, or turn about the axis to move the front leg upwards and consequently drags the rear leg turning pivotally rearwards. After the pivotal member turns and passes the apex (vertical to the rocker frame), the chair will be folding, and the rear leg will stop turning rearwards but turning forwards instead, and drags the chair folding to the rocker frame. while the construction set forth above can fold the rocking chair, there are still shortcomings, notably:

1. The pivotal member has a lengthy displacement. The whole folding structure has to change and the length of the pivotal member has to modify to match the front and rear leg. When dimensional variations or tolerances exceed a certain limit, the folding function could be not attainable. Moreover, the pivotal member is suitable only for rocking chairs, but not applicable for other simpler chairs.
2. The pivotal member has serious safety concerns. It could inadvertently damage clothes or even injure children's fingers during folding.

SUMMARY OF THE INVENTION

The primary object of the present invention is to resolve the foregoing disadvantages. The invention aims to provide a sliding displacement yoke on the support frame of a folding chair or the seat pad of a chair such that the displacement yoke will slide on the support frame and chair during folding process to allow the folding chair and chair extending or folding thereby to decrease folding displacement and enhance safety.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
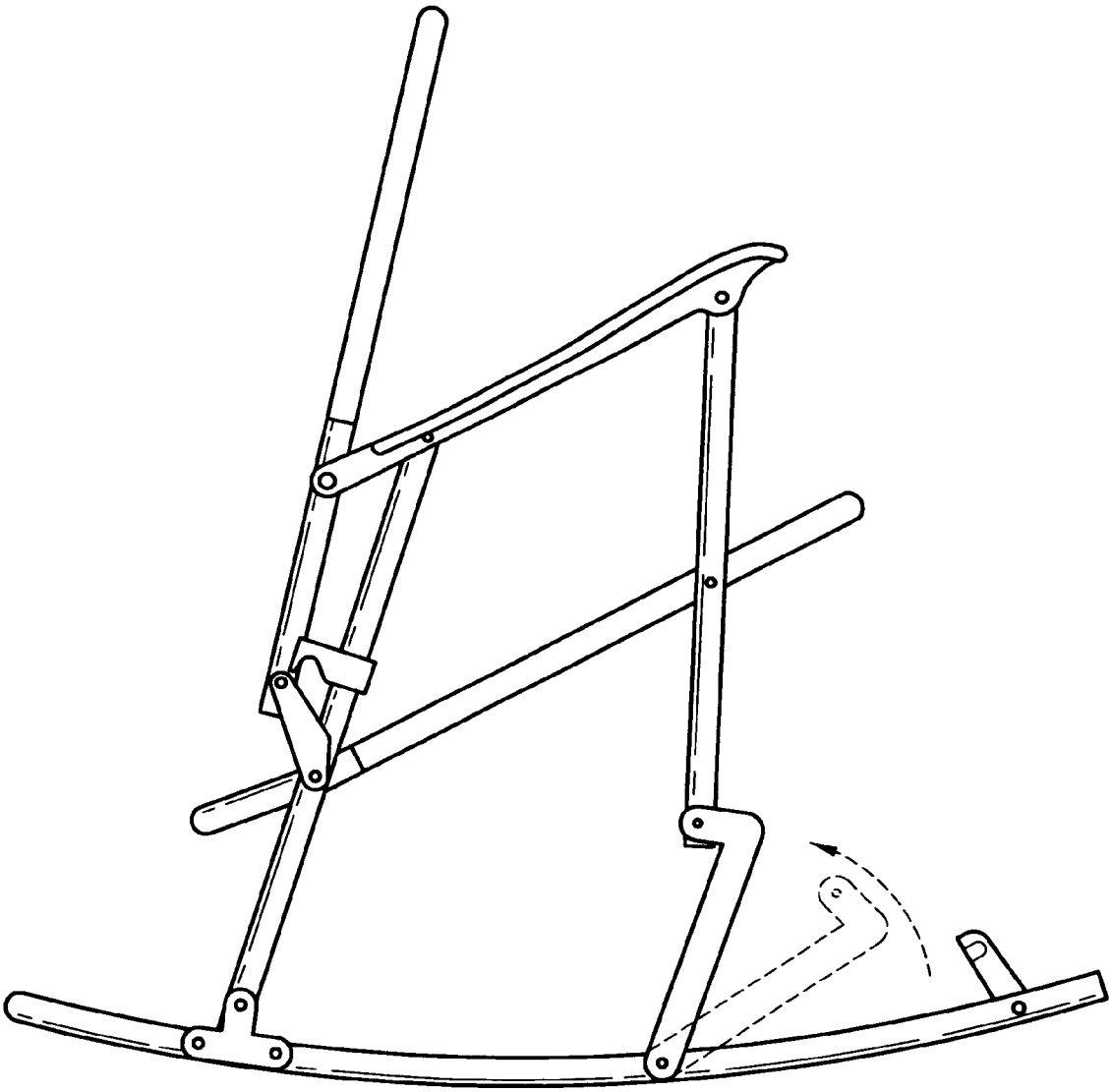
FIG. 1 is a schematic view of a conventional folding chair.
Figure 2:
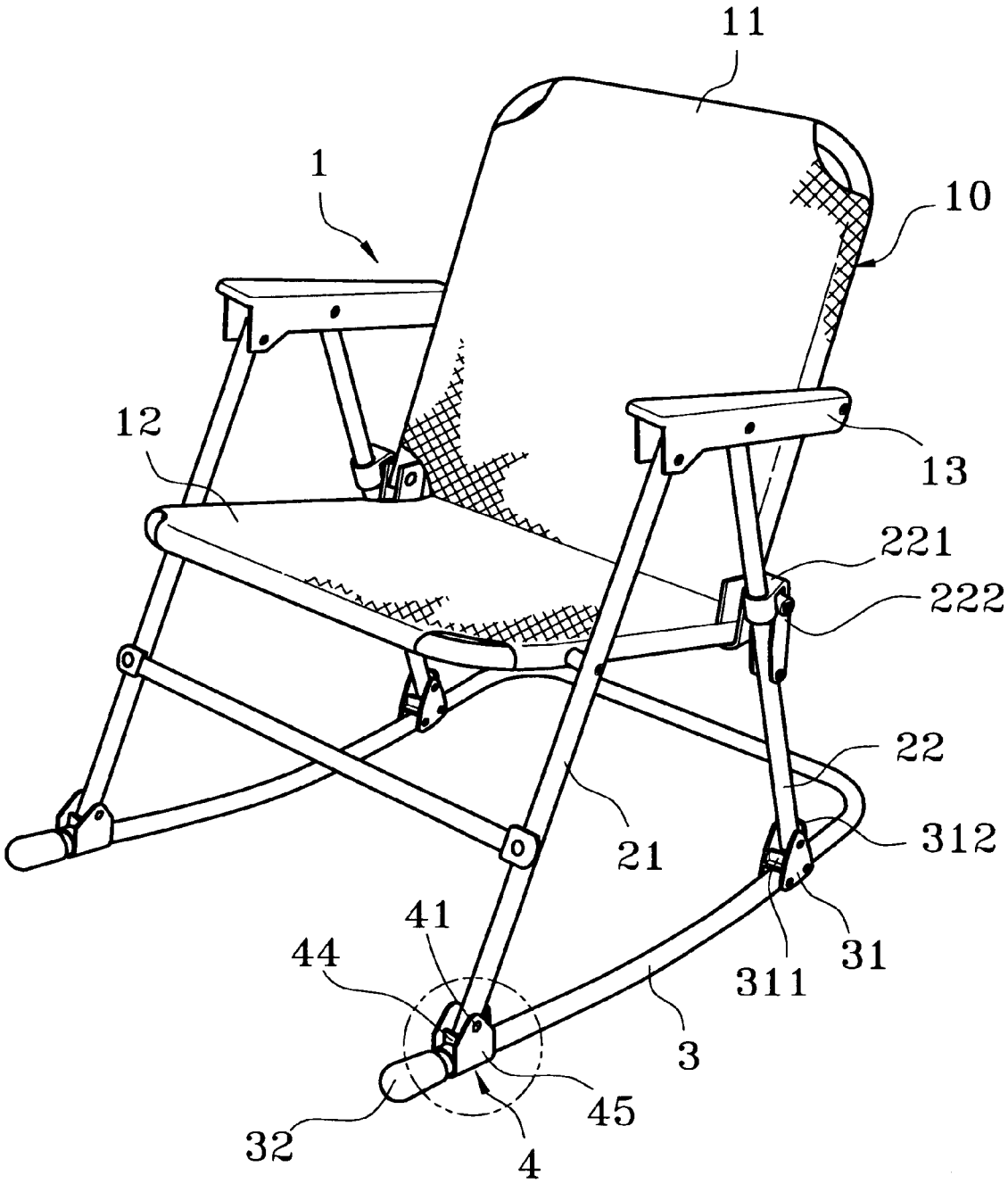
FIG. 2 is a perspective view of a folding chair according to the invention.
Figure 3:
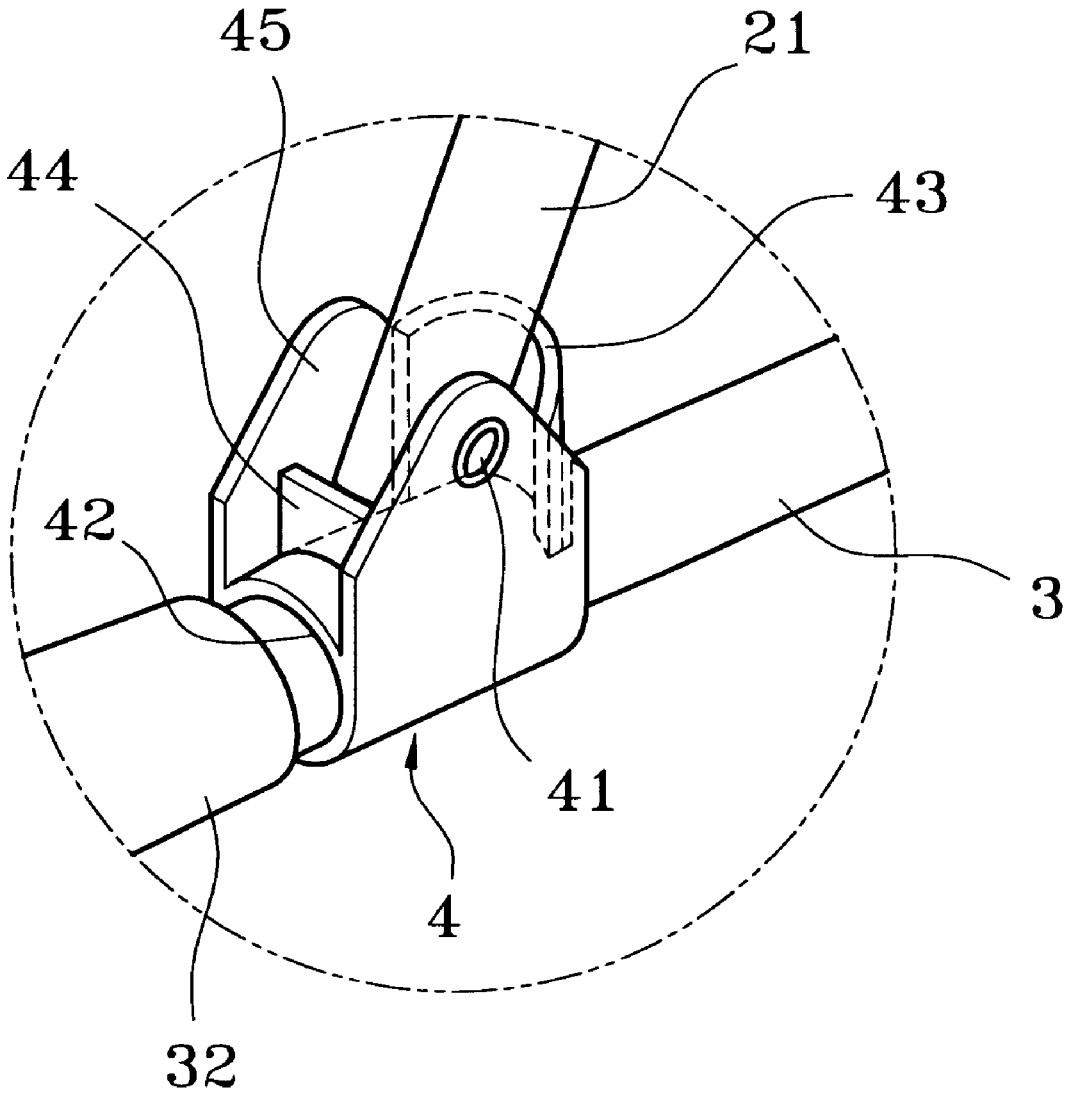
FIG. 3 is a fragmentary perspective view of a displacement yoke of the invention.

Referring to FIGS. 2 and 3, the folding chair 1 of the invention consists of a seat frame 10 for seating people, a pair of front leg 21 and rear leg 22 pivotally located at two sides of the seat frame 10, and a support frame 3 fastened to the front and rear leg 21 and 22. The seat frame 10 includes a seat pad 12 pivotally engaging with the middle section of the front and rear legs 21 and 22, a backrest 11 which has a lower end pivotally engaged with the rear end of the seat pad 12, and a pair of armrests 13 pivotally engaging with one side of the backrest 11 and upper sections of the front and rear leg 21 and 22. There is an anchor yoke 31 mounted to the support frame 3 for engaging with the rear leg 22. There is a displacement yoke 4 mounted to the support frame 3 for engaging with the front leg 21. The displacement yoke 4 has a displacement trough 42, two anchor flanges 45 extending upwards at two sides and a pin 41 passing through the anchor flanges 45 and front leg 21 to make the front leg 21 pivotally engaging with the displacement yoke 4. When the folding chair 1 is at the extending condition, the displacement yoke 4 is stopped by a guarding bushing 32 mounted at the front end of the support frame 3 from slipping out of the support frame 3. The displacement yoke 4 and anchor yoke 31 have respectively a pair of guarding ledges 43, 44 and 311 and 312 located at the moving direction of the front and rear leg 21 and 22 for preventing people's fingers, especially children's, from slipping into the yokes 4 and 31 and getting hurt when the folding chair 1 is folding or extending. The rear leg 22 further has a sliding member 221 with a latch notch 223 formed thereon. There is an anchor lever 222 fastening to the rear leg 22 and backrest 11. When the folding chair 1 is at the extending condition, the sliding member 221 may be moved downwards to engage with the anchor lever 222 to prevent the folding chair 1 from inadvertently folding or collapsing to enhance the safety.

Figure 4A:
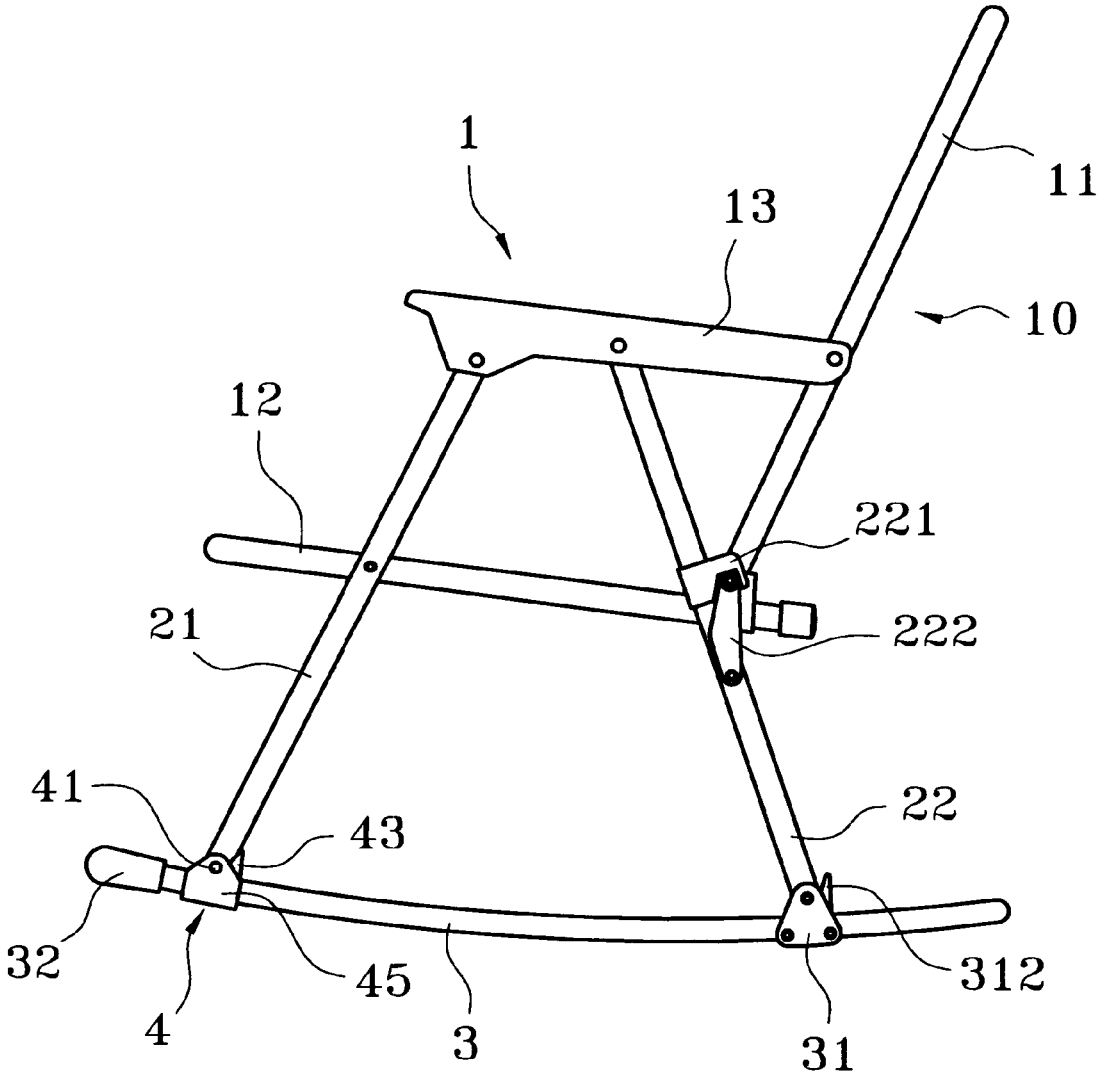
FIGS. 4A, 4B and 4C are schematic views of a folding chair under folding processes according to the invention.
Figure 4B:
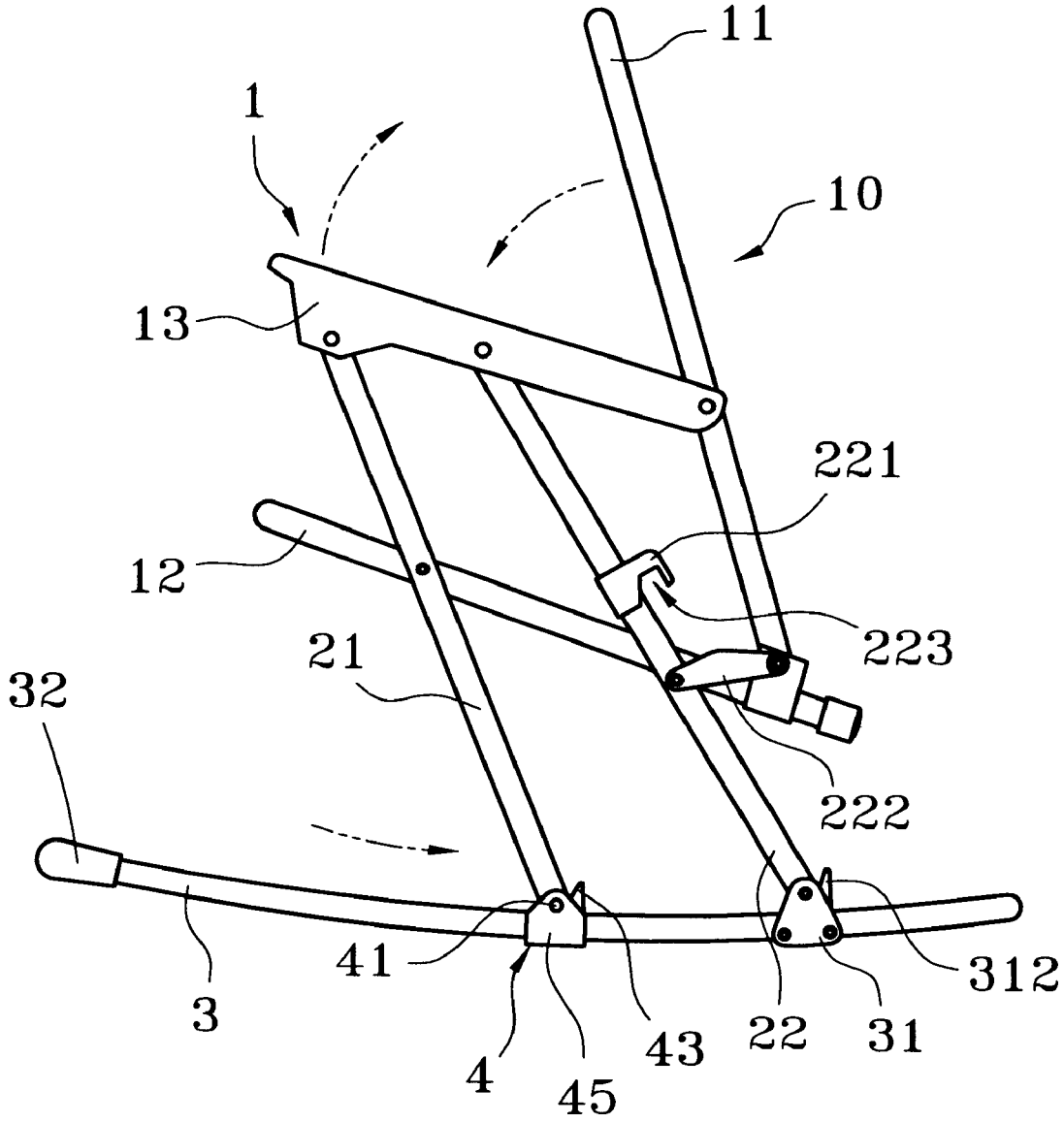
Figure 4C:
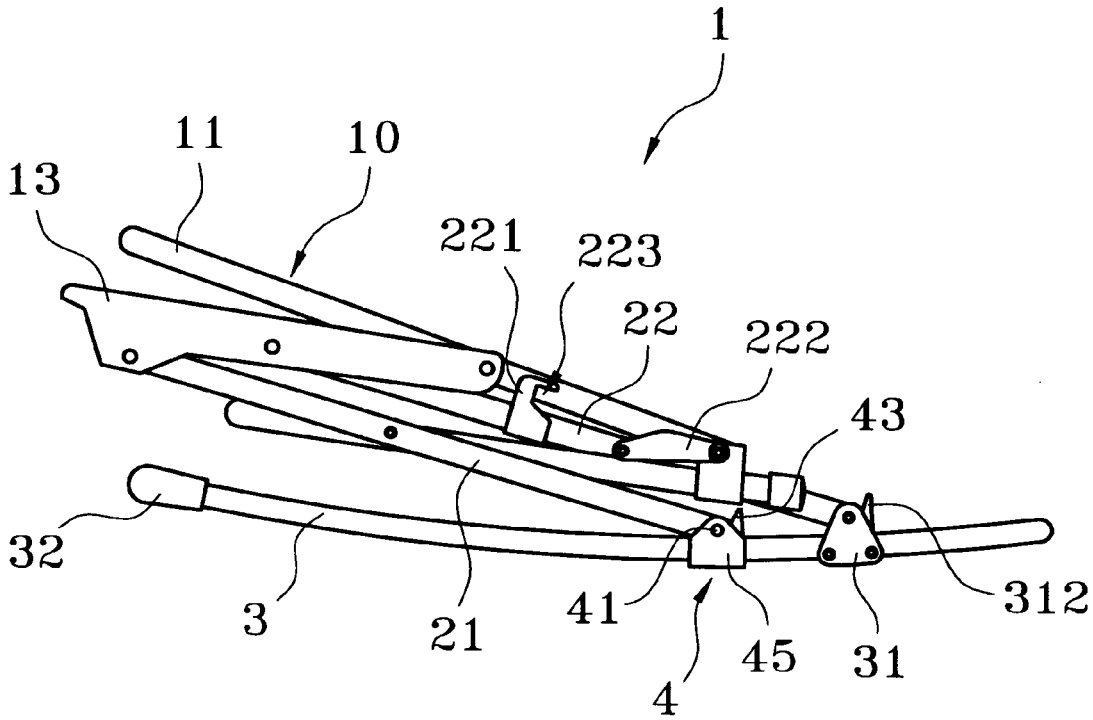

Referring to FIGS. 4A and 4B, when to fold the folding chair 1, first, disengage the sliding member 221 from the anchor lever 222, then apply force on the seat pad 12 and backrest 11 of the seat frame 10 to move the seat pad 12, backrest 11, armrests 13 and front and rear leg 21 and 22 turning relatively to one another about the pivotal joints. The rear leg 22 turns towards the support frame 3 about the fulcrum located at the anchor yoke 31. During folding, the front leg 21 moves the displacement yoke 4 sliding along the support frame 3 towards the anchor yoke 31 so that the seat frame 10 will be folded downwards toward the support frame 3 to become a folding state as shown in FIG. 4C.

Figure 5:
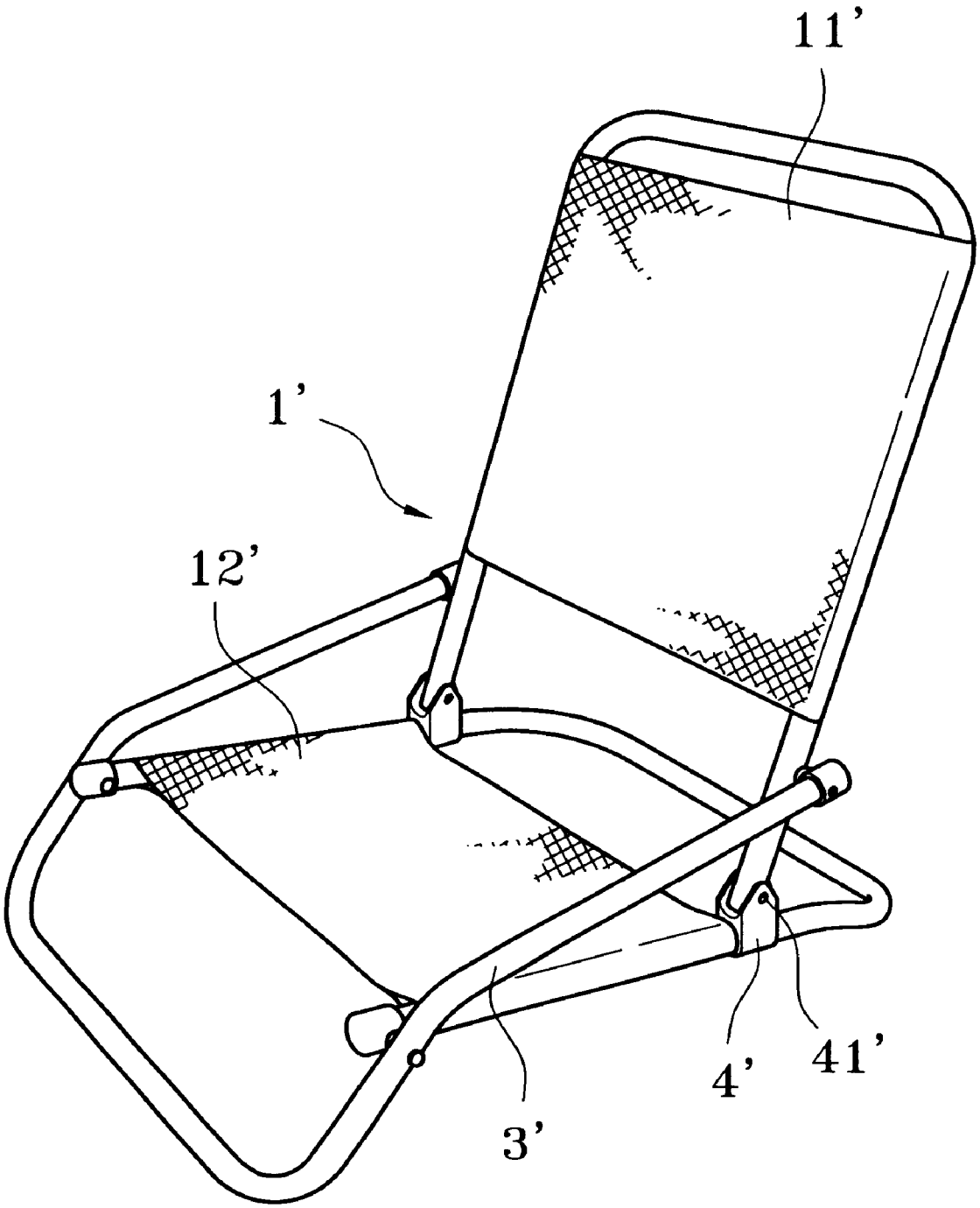
FIG. 5 is a perspective view of a chair according to the invention.
Figure 6:
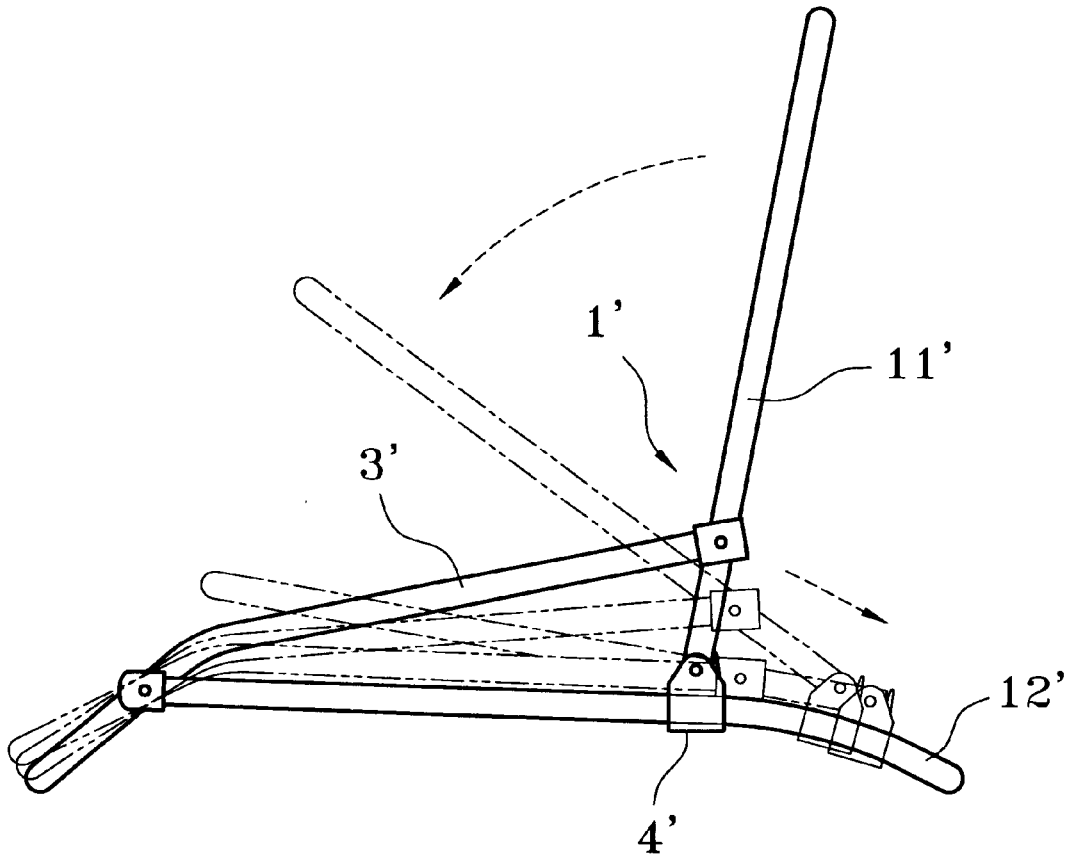
FIG. 6 is a schematic view of a chair at a folding state according to the invention.

Referring to FIG. 5, the invention is adopted to a chair 1' to facilitate folding. The chair 1' includes a seat pad 12' for seating people, a backrest 11' fastened to the seat pad 12' and a support frame 3' fastening to two sides of the seat pad 12' and backrest 11'. The backrest 11' and seat pad 12' are fastened by a displacement yoke 4' which is coupled to seat pad 12'. Thus the junctures of the support frame 3' and seat pad 12' and backrest 11' may function as fulcrums to move the displacement yoke 4' along the seat pad 12' for a selected displacement when the backrest 11' and the seat pad 12' subject to a force thereby to fold or extend the chair 1'.

What is claimed is:

1. A folding chair disposable between folded and unfolded positions, the chair comprising:

(a) a seat frame for seating people and having two sides, a pair of front and rear legs pivotally located at each side of the seat frame, a support frame fastened to the two pairs of front and rear legs;

(b) a slide folding structure including a pair of anchor yokes fixedly mounting the rear legs to the support frame, a pair of displacement yokes slidably mounting the front legs to the support frame, a pair of sliding members mounted on the rear legs, each sliding member having a latch notch formed thereon, a pair of anchor levers, each anchor lever having a first end secured to the backrest and a second end secured to a rear leg, the sliding members being slidable along the rear legs for engagement with the anchor levers to maintain the chair in the unfolded position; and (c) wherein the displacement yokes are moveable along the support frame and driven by the front legs when force is applied to the seat frame, thereby permitting the chair to be folded and unfolded about a pair of fulcrums defined by the anchor yokes.

2. The folding chair of claim 1, wherein the seat frame further includes a seat pad pivotally engaged with a middle section of each of the front and rear legs, a backrest having a lower end pivotally engaged with a rear end of the seat pad, and a pair of armrests, each armrest pivotally engaged with a side of the backrest and upper sections of a pair of the front and rear legs.

3. The folding chair of claim 1, further including a guarding bushing mounted to the front end of the support frame for restricting the movement of each displacement yoke.

4. The folding chair of claim 1, wherein each displacement yoke has a displacement trough, a pair of anchor flanges extending upwardly at two sides and a pin passing through the anchor flanges and the front leg for pivotally engaging the front leg with the displacement yoke.

5. The folding chair of claim 1, wherein each displacement yoke includes a pair of guarding ledges positioned along the direction or movement of the front leg.

6. The folding chair of claim 1, wherein each anchor yoke includes a pair of guarding ledges positioned along the direction of movement of the rear leg.

* * * * *